United States Patent [19]

Jacobson

[11] Patent Number: 4,533,832

[45] **Date of Patent: * Aug. 6, 1985**

[54] RADIATION ATTENUATION MODULES AND SYSTEM AND METHOD OF MAKING THE MODULES

[76] Inventor: Earl B. Jacobson, 510 S. Shore Dr., Crystal Lake, Ill. 60014

[ * ] Notice: The portion of the term of this patent subsequent to Feb. 21, 2001 has been disclaimed.

[21] Appl. No.: 566,694

[22] Filed: Dec. 29, 1983

[51] Int. Cl.[3] ..... G21C 11/00; G21F 3/02

[52] U.S. Cl. ..... 250/519.1; 250/517.1; 376/287

[58] Field of Search ..... 250/515.1, 517.1, 519.1; 376/287, 260

[56] References Cited

U.S. PATENT DOCUMENTS

| | | | |
|---|---|---|---|
| 715,249 | 12/1902 | Dunbar . | |
| 2,857,525 | 10/1958 | Ferdon | 250/519.1 |
| 3,239,669 | 3/1966 | Weinberger | 250/519.1 |
| 3,256,442 | 6/1966 | Sedlak | 250/519.1 |
| 3,265,898 | 8/1966 | Lehmer . | |
| 3,342,036 | 9/1967 | Gruget | 250/519.1 |
| 3,749,401 | 7/1973 | Hayko | 273/95 R |
| 3,886,751 | 6/1975 | Labora | 61/3 |
| 3,922,832 | 12/1975 | Dicker | 52/742 |
| 4,432,932 | 2/1984 | Jacobson | 250/519.1 |

FOREIGN PATENT DOCUMENTS

| | | | |
|---|---|---|---|
| 2461243 | 6/1979 | Fed. Rep. of Germany | 250/519 |

*Primary Examiner*—Bruce C. Anderson

*Attorney, Agent, or Firm*—Winburn & Gray, Ltd.

[57] ABSTRACT

A self-supporting modular radiation attenuation system formed from a plurality of modules stacked on one another in any desired alignment to protect workers from radiation exposure. The modules include a skin assembled with a radiation attenuation medium therein and shaped to mate with one another when assembled. The medium can be lead particles or compressed lead wool. The outer module skin is sufficiently dimensionally stable to support stacking; however, flexible enough to allow the modules to conform to irregular surfaces. The modules can include a particle binder and the system can include framing to support the modules.

30 Claims, 17 Drawing Figures

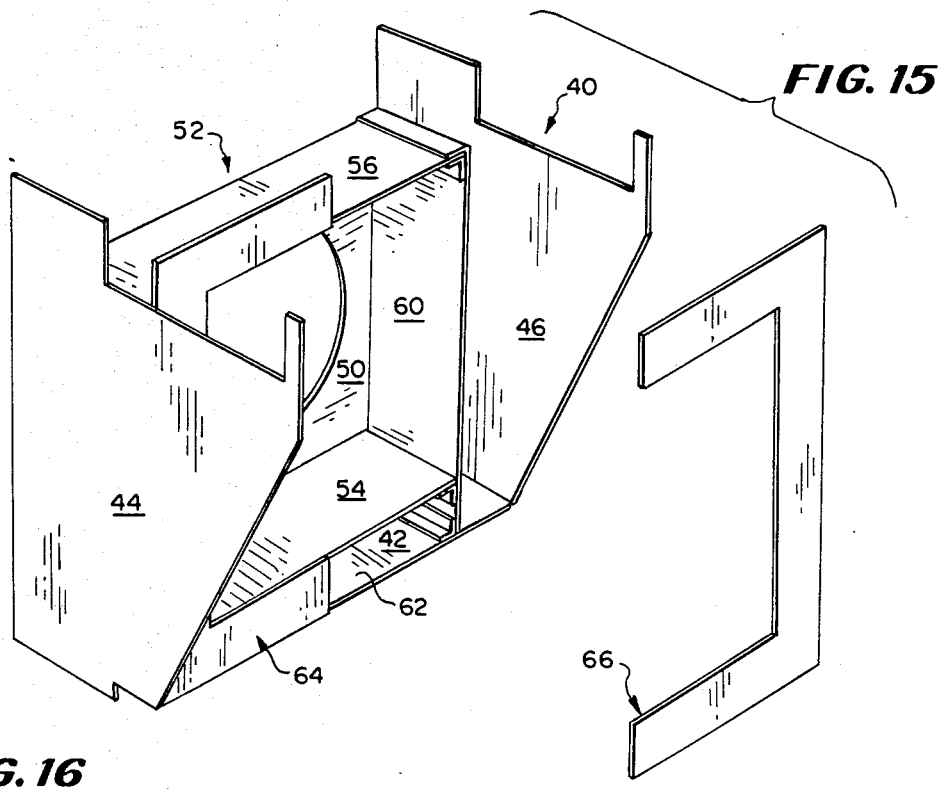
FIG. 16
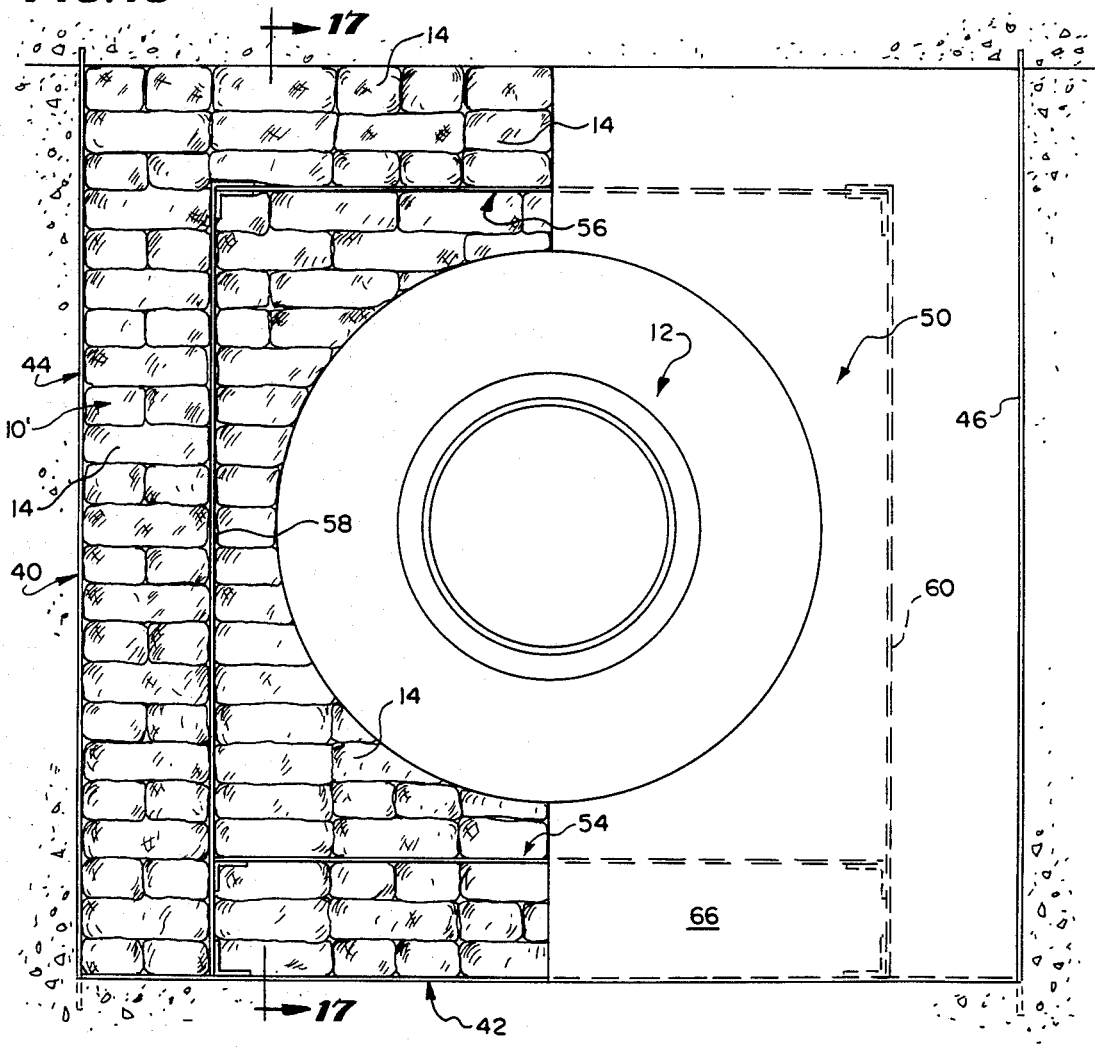

RADIATION ATTENUATION MODULES AND SYSTEM AND METHOD OF MAKING THE MODULES

BACKGROUND OF THE INVENTION

The invention relates generally to radiation attenuation modules and systems and more particularly to a plurality of preformed modules which are assembled into the radiation attenuation system. The modules are designed to be temporarily assembled by stacking in any desired location and alignment and can conform with irregular shapes.

In nuclear power plants and in dealing with radiation wastes in general, it is desirable to be able to put a portable or temporary shielding system in place with a minimum of exposure to the workers in placing and removing the attenuation system. The system should have maximum radiation attenuation as well as ease in utilization.

Each worker in a radiation emitting environment typically is attired in protective clothing; however, shielding is desired when the workers have to be in a radiation area for any length of time. Further the amount of exposure to each worker should be as small as possible. In a radiation area this has typically been accomplished by controlling the time of exposure and the proximity of each worker to the radiation source. Shielding influences the amount of exposure in a time period by altering the radiation environment. The shielding decreases the amount of radiation to which each worker is exposed in a time period.

Attempts to reduce the radiation exposure, such as around a reactor head during refueling operations, around boiling water generator pipes, or in waste removal, have been made. Such attempts have included placing lead shielding in the form of blankets, sheets or solid lead bricks around the radiation source or providing a frame with balloon or bag type constructions which are then filled with water. Some attempts have also been made to provide large hollow shells which are then filled with a radiation attenuation fluid. These non-integrated systems have several disadvantages including exposure between the lead members or bags. These prior art units are cumbersome to work with, generally are not free standing and are not easily adaptable to the irregular work spaces which often exist in the radiation environment.

One system which has been utilized, has been formed from a plurality of solid lead pieces and precision lead bricks. The bricks can be stacked; however, they can easily be nicked or dented, the raw uncovered lead can be contaminated, they are not deformable to fit irregular shapes and they generally are too heavy to easily be placed. Raw lead also is not compatible with the nuclear power generating environment, since it will chemically react with and contaminate stainless steel.

SUMMARY OF THE INVENTION

The above and other disadvantages of prior art radiation attenuation systems and techniques are overcome in accordance with the present invention by providing a self-supporting modular attenuation system which easily can be assembled in any desired configuration between the radiation source and the work area. The system is formed from a plurality of radiation attenuation modules which have a shape to conform with adjacent modules when assembled by stacking onto one another in the desired alignment. The modules are formed from an outer skin and an internal radiation attenuation medium.

The medium can be lead particles or compressed lead wool. The skin is substantially dimensionally stable, but allows some flexibility in conforming the modules against irregular surfaces. The modules can include a binding medium when the lead particles are utilized to prevent the particles from becoming free if the skin is ruptured. The system can include framing to assist in assembling the modules around a radiation emitting object or source.

BRIEF DESCRIPTION OF THE DRAWINGS

FIGS. 14–15 illustrate one framing arrangement for assembling the modules of the invention;

FIG. 16 is a front plan view of one module and frame assembly of the modular radiation attenuation system of the invention.

DESCRIPTION OF THE PREFERRED EMBODIMENTS

Figure 1:
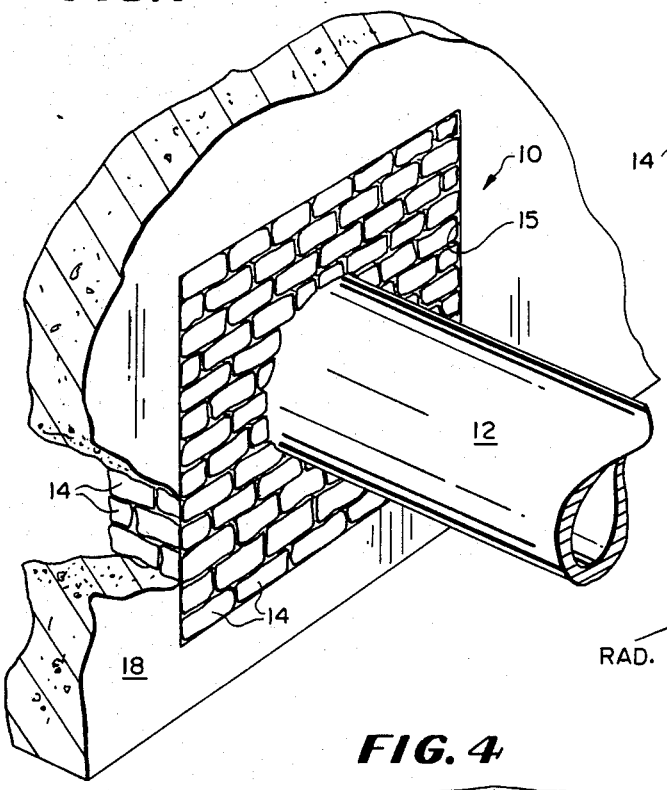
FIG. 1 is a partial perspective view of one assembled embodiment of the modular radiation attenuation system of the invention.
Figure 2:
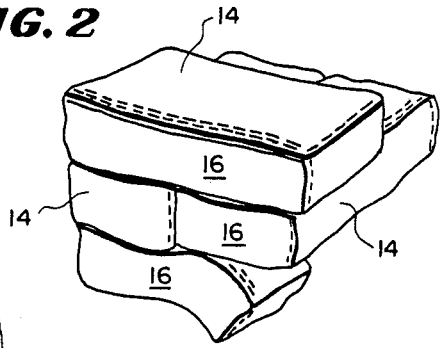
FIG. 2 is a perspective view of a portion of the attenuation system of FIG. 1.
Figure 3:
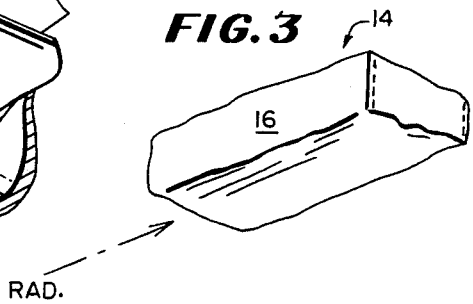
FIG. 3 is a perspective view of one module of the attenuation system.
Figure 4:
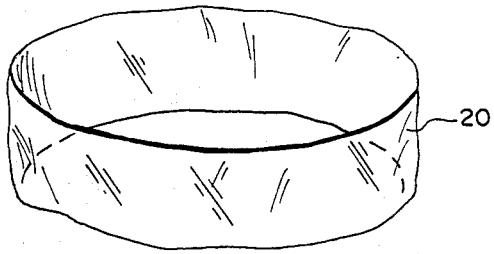
FIG. 4 is a perspective view of a module skin prior to assembly of the module.
Figure 5:
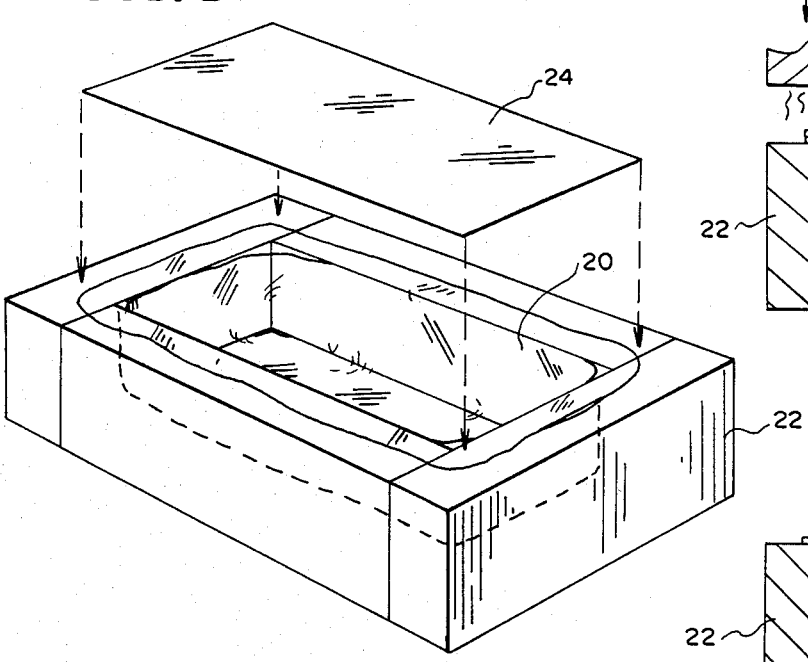
FIGS. 5–8 illustrate forming the modules.
Figure 6:
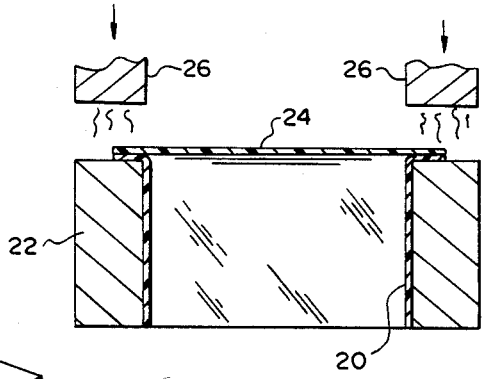
Figure 7:
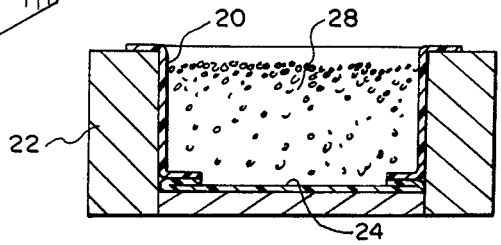

Referring to FIGS. 1–3, an assembled modular radiation attenuation system embodying the invention is designated generally by the reference numeral 10. The modular radiation attenuation system or radiation attenuator 10 is shown assembled around a pipe or nozzle 12 such as an inlet or outlet pipe of a boiling water reactor, and includes a plurality of modules 14. Boiling water reactors have a plurality of inlet and outlet pipes, typically two large inlets and twelve outlet pipes. An opening 15 is provided around each of the pipes, which opening can be as large as five feet by five feet.

Each module 14 generally includes a skin 16 which maintains a stackable preformed shape of the modules 14 and which retains a radiation attenuation medium therein. The skin 16 is substantially dimensionally stable, but is flexible enough to conform to the skin of an adjacent module or the outer irregular surface of the pipe 12 or other radiation emitting object.

Each of the modules 14 is preferably of a generally rectangular shape, which allows them to be conveniently stacked upon one another to form the system 10. The modules 14 are assembled and conformed to one another, the pipe 12 and to a shielding wall 18 which is part of a concrete wall formed around the reactor. This provides a substantial gross elimination of radiation exposure through the opening 15. The modules 14 can also be considered soft bricks and also can be stacked inside of the pipe 12, if it is open, to eliminate radiation therefrom. The modules 14 are stacked around the pipe 12 or other radiating emitting object in any convenient manner; however, the modules 14 provide the maximum radiation attenuation when aligned in the direction of the radiation path as illustrated in FIG. 3.

Referring to FIGS. 4–7, the modules 14 can include a flexible inner liner or skin portion 20, which is placed in a mold 22. The liner 20 can be a section of a plastic or pvc tubing, preferably at least 20 mils thick. A wall piece 24 of the same or similar material is then secured to the portion 20 by a heating element 26 or by sewing or adhesive. The sealed pieces 20 and 24 are then inserted in the mold and filled with a radiation attenuation medium 28, such as lead shot. The medium 28 can also be compressed steel wool, in a single piece, in layers or slabs. The inner liner 20 is also useful in the case of the compressed lead wool, since the wool has a lot of fine particles or pieces and the liner prevents migration of the pieces from the module.

In the case of lead particles or shot, the flexible inner liner provides a method of containing the particles during assembly and provides shock relief for the modules 14 after assembly. When utilizing the lead particles, a binding medium can be preferable, since it reduces or completely eliminates the free migration of the particles if the modules 14 are ruptured. The binding medium can be a water soluble paste-like binder, which hardens when exposed to air. The binding medium provides a number of benefits. The medium fills the spaces between the particles without increasing the total volume of the modules 14 and without decreasing the shielding efficiency of the modules 14. The material adds as much as twenty-five to thirty percent volume to the modules 14 by filling in the spaces, while only adding about five percent to the total weight of the modules 14. The particles as mentioned above, are also prevented from migrating by the binding medium and it makes the modules self sealing when torn or ripped since it hardens when exposed to air. One convenient medium is a latex caulking material, which is compatible with the austenitic stainless steel found in some generating plants.

Figure 8:
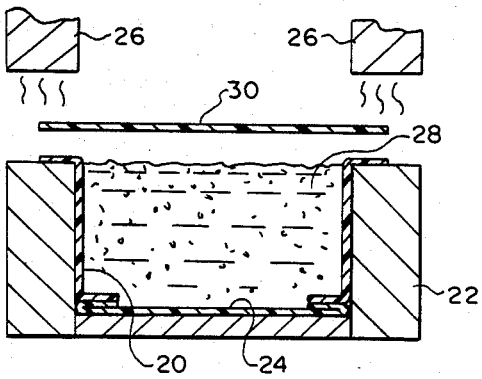
Figure 9:
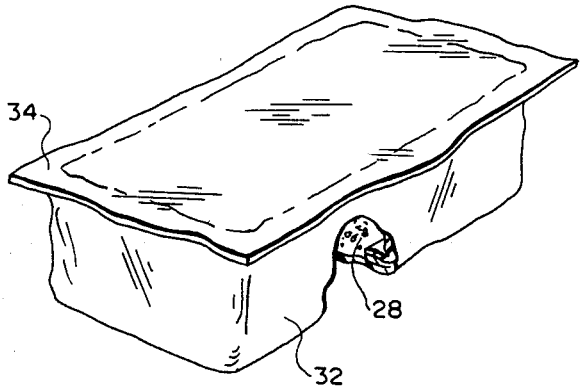
FIG. 9 is a perspective view of a partially assembled module.
Figure 10:
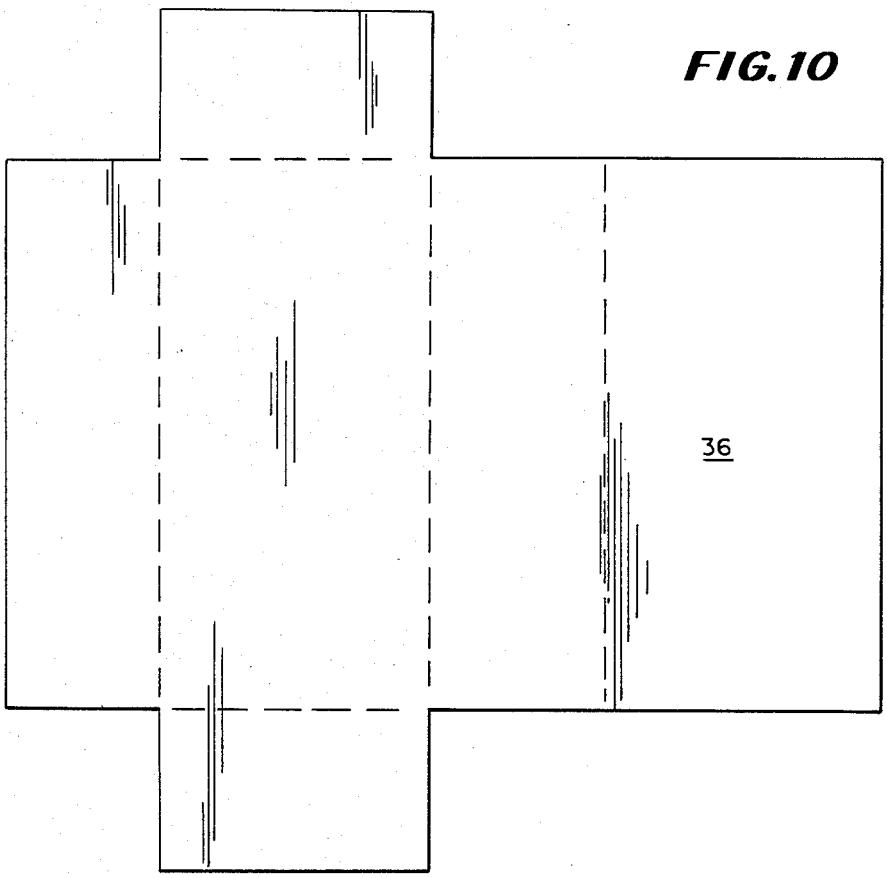
FIG. 10 is a top plan view of the module outer skin.

As illustratd in FIG. 8, the attenuation medium 28 is then sealed in by a second wall piece 30, in a similar manner as the piece 24. The sealed pieces provide an integral flexible inner liner or skin 32 as illustrated in FIG. 9. The skin 32 includes a lip 34, which can be heat sealed and sewn if desired.

Figure 11:
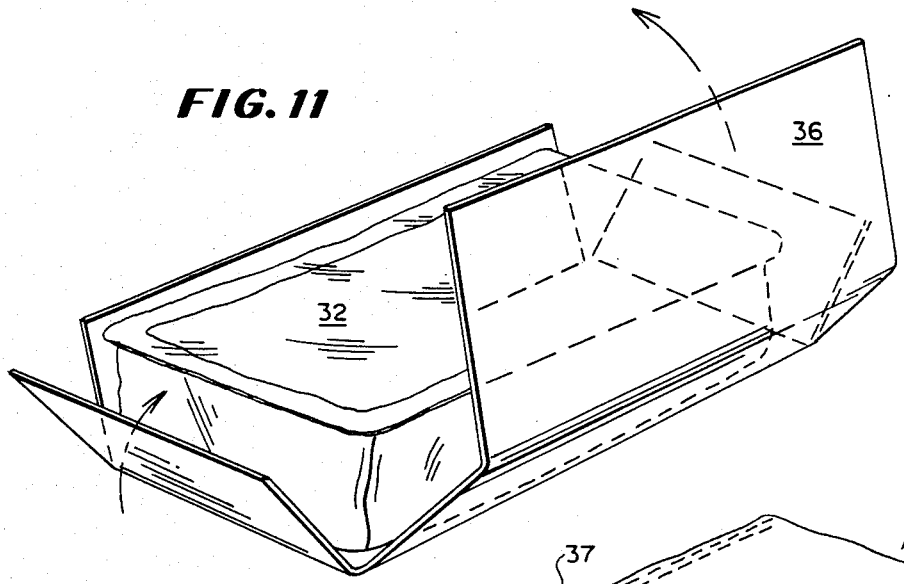
FIG. 11 is a perspective view of the module with the outer skin partially assembled.
Figure 12:
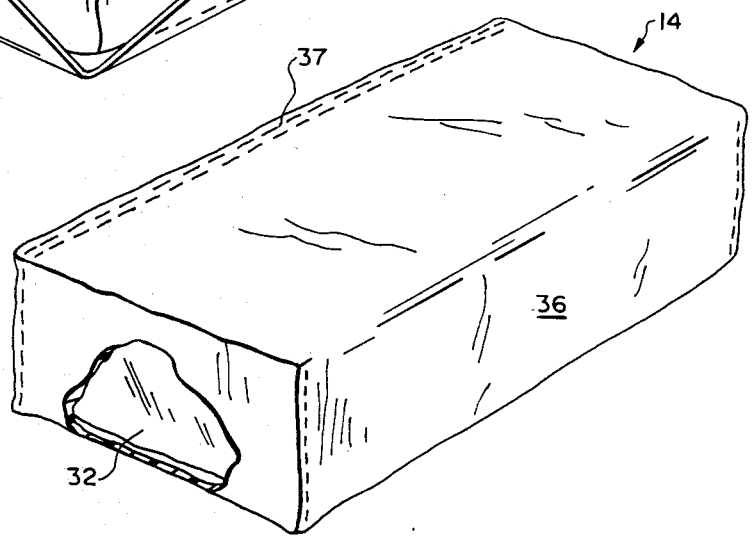
FIG. 12 is a partial sectional perspective view of one assembled module embodiment of the radiation attenuation system of the invention.

An outer skin 36, preferably is then secured around the inner skin 32 to complete the module 14. The outer skin 36 is sewn and/or heat sealed around the skin 32 as illustrated in FIG. 11, to form the module 14 as illustrated in FIG. 12. The skin 36, preferably is formed from a fairly rigid material such as reinforced, laminated or coated pvc or nylon or polyester inner weave so that the modules 14 maintain a dimensionally stable form. The skin 36 preferably is double sewn and inverted so only one outside closing seam 37 is exposed.

Figure 13:
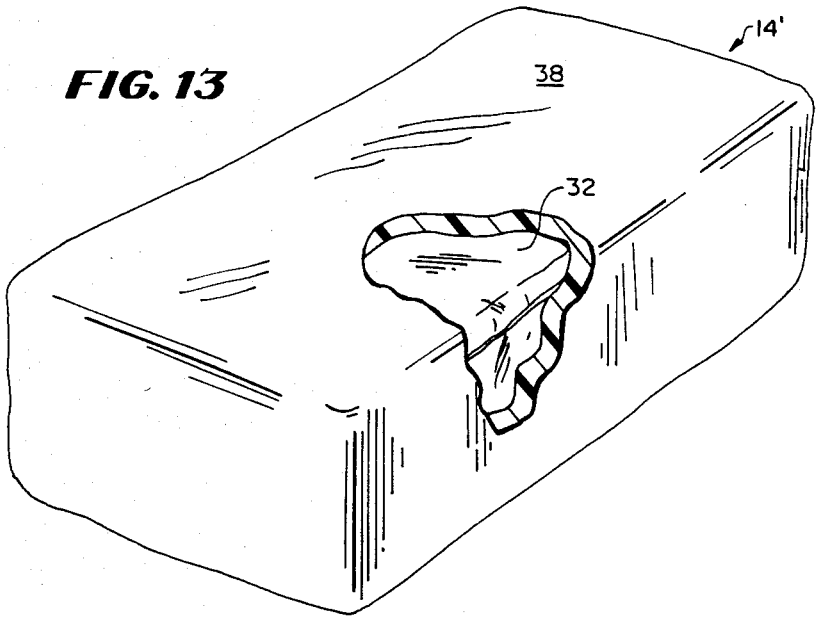
FIG. 13 is an assembled perspective view of a second module embodiment of the invention.

A second module embodiment 14' is best illustrated in FIG. 13. The steps of forming the inner skin 32 can be the same as those described above; however, an outer skin 38 is formed by a unitary plastic material, such as by coating or dipping the liner in plastic.

Figure 14:
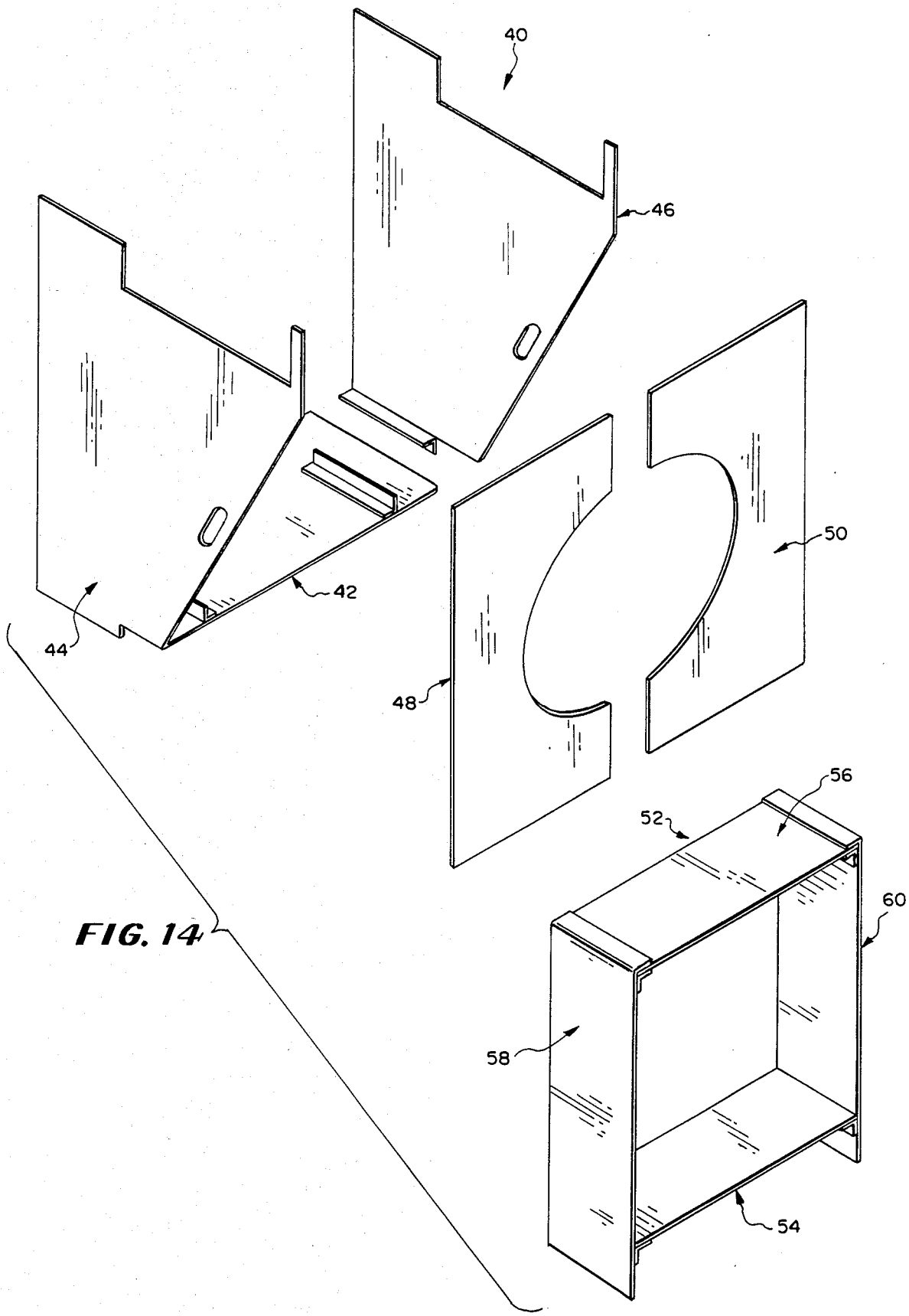

The system 10 can be free standing, since the modules 14 are stackable on one another; however, if desired a frame 40 can be utilized such as illustrated in FIGS. 14–16. The frame 40 can include a bottom support plate 42 and a pair of side plates 44 and 46. When utilized with a nozzle or the pipe 12, the frame 40 can include a pair of retainer plates 48 and 50. A rectangular frame unit 52 can be utilized to frame the pipe 12. The unit 52 includes bottom and top shelf plates 54 and 56, respectively, and a pair of side retainer plates 58 and 60. The unit 52 sets on the bottom support plate 42 forming a cavity 62 which can be filled with the modules 14. Once the cavity 62 is filled, a pair of perimeter retaining plates 64 and 66 can be secured to form the finished frame 40. The shape and configuration of the frame 40 can be varied as desired in accordance with the configuration of the radiation emitting object to be shielded.

Figure 17:
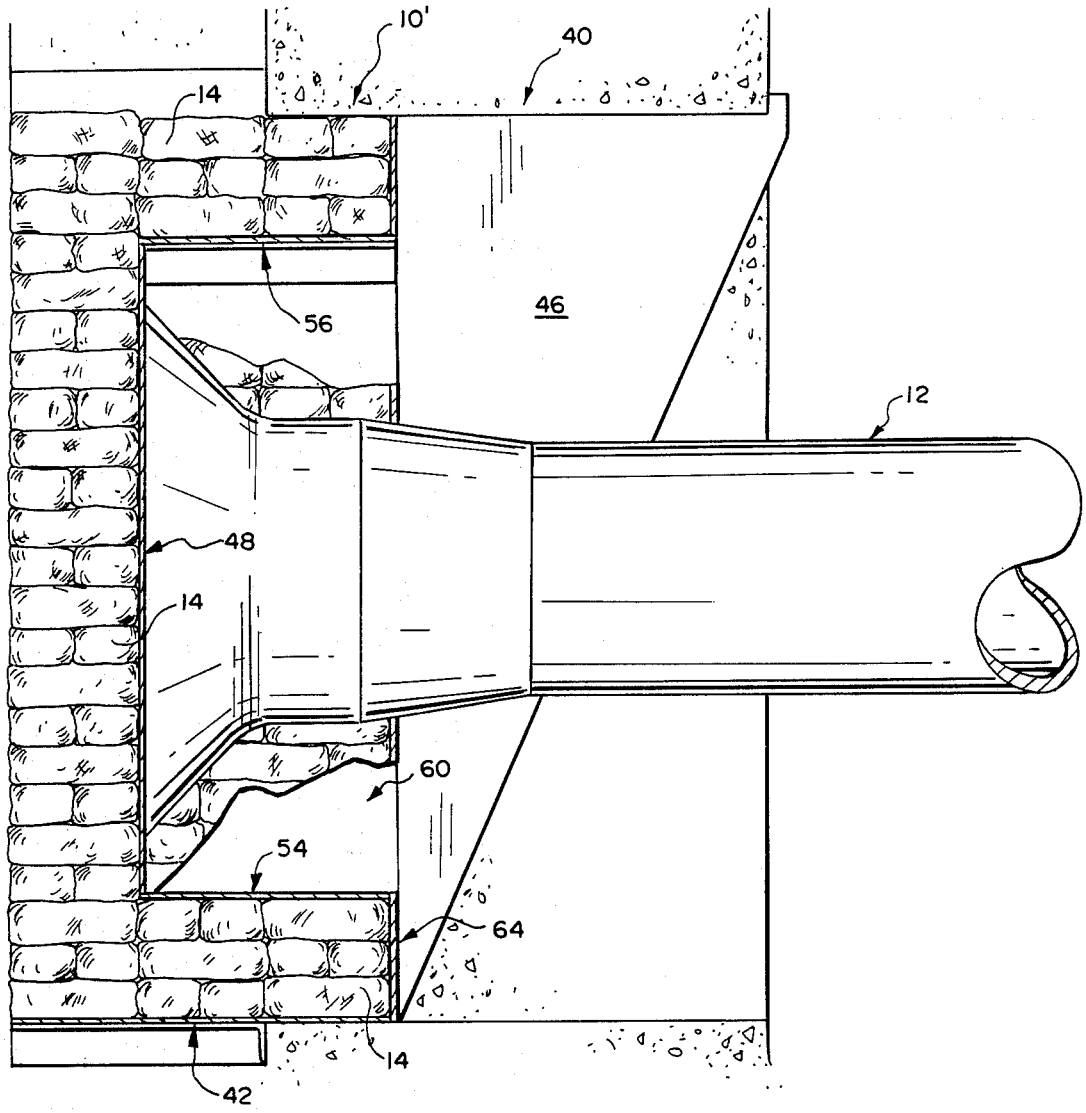
FIG. 17 is a partial side sectional view of the assembly of FIG. 16 taken along the line 17—17 therein.

The assembled system 10' utilizing the frame 40 is best illustrated in FIGS. 16 and 17. The frame 40 provides faster assembly and disassembly of the modules 14, as well as a fixed location and framework for the assembly which facilitates the proper placement and conforming of the modules 14 to substantially eliminate radiation exposure. The assembly 10 is especially useful in reducing radiation exposure in set up and disassembly, but also provides for maximum protection while the assembly 10' is in place, such as when working on the pipe 12.

Many modifications and variations of the present invention are possible in light of the above teachings. The skin can be formed from any flexible, yet substantially rigid material which can provide the stackable dimensionally stable module form, but allows for some flexiblity. The skin can be formed out of numerous impervious materials, such as 30 mil pvc, reinforced pvc or nylon, fiberglass, rubber or laminates of the materials, such as reinforced, rubberized or plasticized cloth. The modules can be designed for any desired shape, height and width, although one convenient size is two inches by three inches by six inches. Such a size permits the modules to weigh an easily manageable weight of about ten pounds, which is less than half as heavy as a conventional solid lead precision brick. The shielding efficiency of the modules 14 with lead shot or wool is approximately sixty percent of that of solid lead. Therefore a mean free path length through the modules of about six and one half inches is equivalent to four inches of solid lead. It is therefore, to be understood that within the scope of the appended claims, the invention may be practiced otherwise than as specifically described.

What is claimed and desired to be secured by Letters Patent of the United States is:

1. A radiation attenuation system, comprising:

a plurality of radiation attenuation module means, each having a substantially dimensionally stable preformed body shaped to stack against and on top of adjacent module means around a radiation emitting object, each said substantially dimensionally stable body having sufficient flexiblity to be molded against one or more irregular surfaces of said radiation emitting object, when said module means are stacked into an assembly around at least a portion of said radiation emitting object for substantially eliminating radiation exposure from said radiation emitting object.

2. The radiation attenuation system according to claim 1, wherein:

each said preformed body includes skin means for retaining a radiation attenuation medium within said body in said preformed shape.

3. The radiation attenuation system according to claim 2, wherein:

said radiation attenuation medium includes a plurality of lead particles.

4. The radiation attenuation system according to claim 3, wherein:

said lead particles are lead shot.

5. The radiation attenuation system according to claim 3, wherein:

each said skin means include substantially flexible inner skin means for retaining said radiation attenuation medium and substantially rigid outer skin means for maintaining said preformed body shape and to assist in preventing ruptures of said inner skin means.

6. The radiation attenuation system according to claim 3, wherein:

said radiation attenuation medium further includes a binding medium for substantially retaining said lead particles from free movement if said skin means are ruptured.

7. The radiation attenuation system according to claim 6, wherein:

said binding medium also self seals said skin means if said skin means are ruptured.

8. The radiation attenuation system according to claim 2, wherein:

said radiation medium includes compressed lead wool.

9. The radiation attenuation system according to claim 8, wherein:

said compressed lead wool includes a plurality of sheets of lead wool.

10. The radiation attenuation system according to claim 8, wherein:

each said skin means include substantially flexible inner skin means for retaining said radiation attenuation medium and substantially rigid outer skin means for maintaining said preformed body shape and to assist in preventing ruptures of said inner skin means.

11. The radiation attenuation system according to claim 1, further including:

frame means for defining said assembled module means around said radiation emitting object.

12. The radiation attenuation system according to claim 1, wherein:

each said preformed body is substantially rectangularly shaped.

13. A radiation attenuation module, comprising:

a substantially dimensionally stable preformed body shaped and adapted to stack against another of said bodies; and said body including skin means for retaining a radiation attenuation medium within said body in said preformed shape.

14. The module according to claim 13, wherein:

said radiation attenuation medium includes a plurality of lead particles.

15. The module according to claim 14 wherein:

said lead particles are lead shot.

16. The module according to claim 14, wherein:

each said skin means include substantially flexible inner skin means for retaining said radiation attenuation medium and substantially rigid outer skin means for maintaining said preformed body shape and to assist in preventing ruptures of said inner skin means.

17. The module according to claim 14, wherein:

said radiation attenuation medium further includes a binding medium for substantially retaining said lead particles from free movement if said skin means are ruptured.

18. The module according to claim 17, wherein:

said binding medium also self seals said skin means if said skin means are ruptured.

19. The module according to claim 13, wherein:

said radiation medium includes compressed lead wool.

20. The module according to claim 19, wherein:

said compressed lead wool includes a plurality of sheets of lead wool.

21. The module according to claim 19, wherein:

each said skin means include substantially flexible inner skin means for retaining said radiation attenuation medium and substantially rigid outer skin means for maintaining said preformed body shape and to assist in preventing ruptures of said inner skin means.

22. The module according to claim 13, wherein:

each said preformed body is substantially rectangularly shaped.

23. A method of making a radiation attenuation module, comprising:

forming a substantially rigid preformed module skin; and substantially filling said skin with a radiation attenuation medium to form a dimensionally stable unit.

24. The method according to claim 23, including:

forming a first substantially flexible inner skin;

filling said inner skin with said radiation attenuation medium; and forming said preformed skin around said inner skin and said radiation attenuation medium.

25. The method according to claim 24, including:

forming said outer preformed skin by coating said inner skin with a plastic material.

26. The method according to claim 24, including:

filling said inner skin with lead particles to form said attenuation medium.

27. The method according to claim 26, including:

filling said inner skin with said particles and a binding medium to prevent free movement of said particles if said skin is ruptured.

28. The method according to claim 26, including:

filling said inner skin with a binding medium which will self seal said skin if it is ruptured.

29. The method according to claim 23, including:

filling said skin with compressed lead wool to form said attenuation medium.

30. The method according to claim 23, including:

forming said preformed skin in a substantially rectangular shape.

* * * * *